United States Patent [19]

Wirth

[11] 4,363,010

[45] Dec. 7, 1982

[54] CONTACT DEVICE FOR A SWITCH

[75] Inventor: Herbert Wirth, Gisikon, Switzerland

[73] Assignee: Weber AG Fabrik Elektrotechnischer Artikel und Apparate, Emmenbrücke, Switzerland

[21] Appl. No.: 263,012

[22] Filed: May 12, 1981

[30] Foreign Application Priority Data

May 28, 1980 [CH] Switzerland ..... 4147/80

[51] Int. Cl.[3] ..... H01H 75/00; H01H 77/00; H01H 83/00

[52] U.S. Cl. ..... 335/6; 200/67 PK; 335/15; 335/192

[58] Field of Search ..... 335/15, 6, 191, 192, 335/200, 175; 200/67 PK

[56] References Cited

U.S. PATENT DOCUMENTS 4,222,019 9/1980 Rusch ..... 335/6

*Primary Examiner*—Harold Broome

*Attorney, Agent, or Firm*—Browdy and Neimark

[57] ABSTRACT

A contact lever has a contact point on one end for a fixed contact element and is supported on its other end on a pin which, when the switch is tripped, is capable of moving along a path transversely to the longitudinal direction of the contact lever. A compression spring acts upon the contact lever between a stop for the contact lever, which is embodied by a housing element and the pin in order to generate the contact pressure to move the pin upon the tripping of a switch. The stop has two protrusions, oriented towards the contact lever, one of which is located farther from the pin and closer to the contact lever than the other. The contact lever, therefore, upon being tripped, pivots first about the protrusion, which is more remote from the pin being moved, and then about the protrusion disposed closer to the pin. As a result, it is possible solely by means of the shaping of the stop to attain a high contact-breaking force at the first instant of the tripping, and to attain a long contact-opening path up until the termination of the pivoting movement of the contact lever.

3 Claims, 3 Drawing Figures

CONTACT DEVICE FOR A SWITCH

FIELD OF THE INVENTION

The invention relates to a contact device in a switch and, in particular, in a circuit breaker, which includes a movable contact lever under spring pressure. At one end, the lever has a point of contact for an associated fixed contact element; at the other end, the lever is supported such that it is both pivotable and, in engagement with a tripping system, displaceable transversely to its longitudinal direction. A stop for the contact lever is disposed between the two ends. When its supported end is displaced, the lever is pivoted about this stop, thus disengaging the point of contact from the fixed contact element.

BACKGROUND OF THE INVENTION

A contact device of this kind is known, for example, from U.S. Pat. No. 4,222,019 which relates to a circuit breaker, in which the contact lever is disposed in the described manner, in the vicinity of the base of the switch housing and parallel to the switch. The end of the contact lever is pivotably supported on a displaceable bearing pin, which also includes a catch, acting as part of the switching lock of the switch. In the known switch, the stop is embodied in the free end of a transverse portion of the switch housing wall. A compression spring, supported on the housing base, acts upon the contact at a point which is located between the bearing pin and the stop. On the one hand, the compression spring generates the requisite contact pressure; on the other, this spring generates a force, which displaces the bearing pin transversely to the longitudinal direction of the contact lever, if the catch is tripped either by an excessive current or as the result of manual actuation of a tilt lever. Thus, under the force of the compression spring, the contact lever comes to rest at the stop and pivots about this stop, causing the separation of the contact lever from the fixed contact element.

In a contact device of this kind, the object is to exert great break-open force on the contact lever in order to assure the reliable breaking of the contact between the contact lever and the fixed contact element, although this contact is at most lightly welded. It is possible, per se, to attain a great break-open force by dimensioning the compression spring to act upon the contact lever in sufficiently massive fashion. However, since this compression spring also acts upon the catch and other tripping elements of the switching lock, an increase in the break-open force of the contact, brought about by making the compression spring more massive, produces an exactly proportional increase in the stress placed on the switching lock of the switch. This occasions increased mechanical wear of the tripping devices, which must accordingly be designed for greater tripping forces, although this is disadvantageous.

OBJECTS AND SUMMARY OF THE INVENTION

The object of the present invention is to create a contact device, of the type described above, but in which a sufficiently great break-open force is attained for the closed contact without exerting a correspondingly great spring force upon the contact lever.

In order to attain this object, the contact device according to the invention has the characteristics which will be described below.

Fundamentally, this object is attained by shifting the position of the rotary axis for the pivoting movement of the contact lever, which effects the contact separation, over the course of the complete pivoting movement, away from a position along the length of the contact lever, in which the torque exerted by the compression spring is relatively great, for the relatively short travel path of the point of contact on the contact lever, and into a position, in which the torque is less but a longer opening path of the point of contact is effected. By thus effecting contact separation with simple means, the invention attains the threefold advantage of a great break-open force, a long opening path and a low spring force, that is, a spring force which is determined only by the desired contact pressure.

One exemplary embodiment of the subject of the invention will now be described with the aid of the drawings.

DESCRIPTION OF THE PREFERRED EMBODIMENTS

Figure 1:
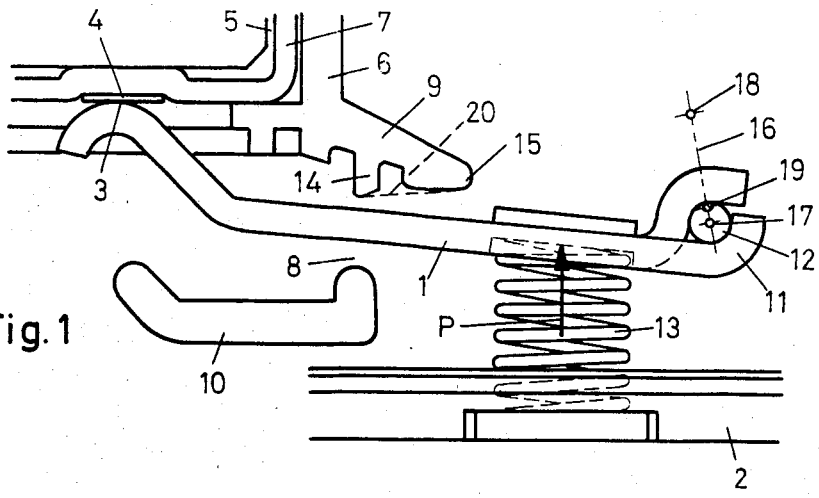
FIG. 1 is a view of the contact device in a circuit breaker, seen in the "on" position.

The contact device, shown in the drawings includes a contact lever 1, which is disposed substantially parallel to the base wall 2 of a switch housing. The contact lever 1, which is bent in hornlike fashion at one end, creates with this end a movable point of contact 3. A fixed contact element 4, located on a current conductor element 7 and held between the interior wall elements 5 and 6 of the switch housing, is associated with the movable point of contact 3.

The contact lever 1 extends through a slot 8, which is defined by a bent free end 9 of the wall element 6 and by a housing rib 10. On its other end, the contact lever is pivotably supported on a bearing pin 12 by means of a hinge element 11. A compression spring 13, supported on the base wall 2, acts upon the contact lever 1, engaging it at a point between the bearing pin 12 and the bent end 9 of the wall element 6. The bent end 9 is structurally characterized by two protrusions 14 and 15 oriented towards the contact lever 1 and spaced apart from one another in the longitudinal direction of the contact lever 1.

From the U.S. Pat. No. 4,222,019, referred to above, it is apparent that in this circuit breaker, for which the contact device according to the invention is illustrated as an exemplary embodiment in FIGS. 1–13, the bearing pin 12 additionally carries a catch which is part of the switching lock of the switch. In the "on" position of the contact lever 1, this catch holds the bearing pin 12 firmly, counter to the force of the spring 13; if the switch is tripped, the catch releases the bearing pin 12, so that the bearing pin 12 may move along a specific path 16 from a first point 17, which corresponds to the "on" position, to a second point 18, which corresponds to the tripped or "off" position, in an abrupt fashion. This catch and its connections with the rest of the switching lock, as well as with the housing elements, which affect the guidance of the bearing pin 12 along the path 16, are not shown in FIGS. 1–3, because the manner of their embodiment is of no special significance for the subject of the present invention; the structure and operation of these elements may be understood from the document cited above.

Figure 3:
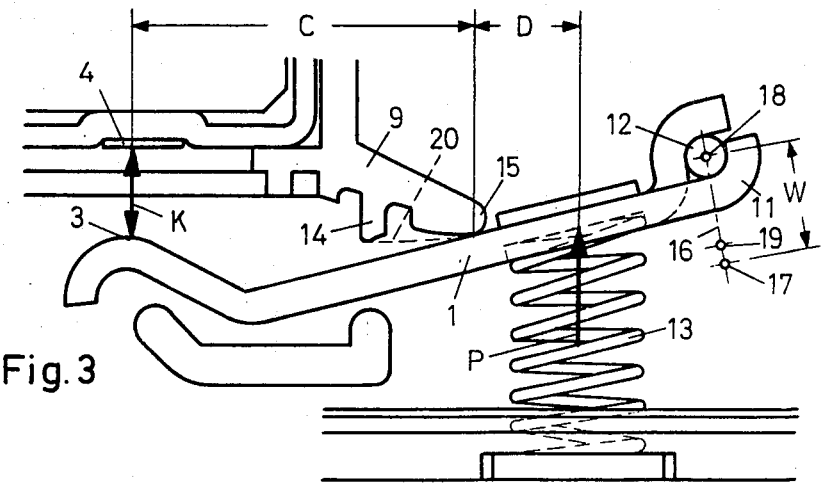
FIG. 3 is a further view of the contact device of FIG. 1, here seen in the "off" position.

The course of the contact lever movement, when the contact lever 1 moves from its "on" position shown in FIG. 1 as the result of the tripping of the switch and reaches its "off" position, as shown in FIG. 3, will be described below.

Since, as already noted, the bearing pin 12 is arrested at point 17 in the "on" position (FIG. 1), the spring 13, exerting the force P on the contact lever 1, presses the hornlike bent end of the contact lever 1 (that is, its point of contact 3) against the fixed contact element 4 of the current conductor element 7, and thus generates the requisite contact pressure.

Figure 2:
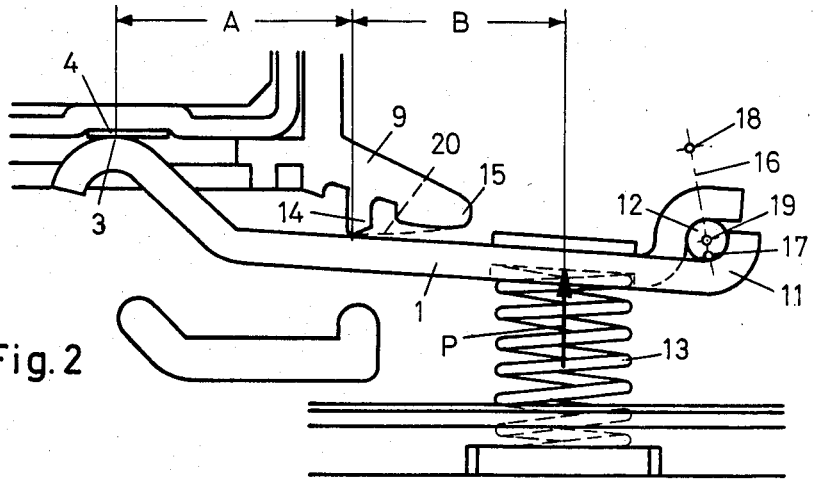
FIG. 2 is a view of the same contact device, seen in a position subsequent to tripping and immediately prior to the separation of the contact.

Upon the tripping of the switch, the bearing pin 12 is released, so that it moves under the pressure of the spring 13 along the path 16. At the instant, at which the bearing pin 12 reaches the point 19 on the path 16, the contact lever 1 touches the protrusion 14 of the bent end 9 of the wall element 6, as is shown in FIG. 2. During the course of the further movement of the bearing pin 12 along the path 16, the contact lever 1 is thus pivoted about the protrusion 14, so that its contact point 3 moves away from the fixed contact element 4. During the further course of this pivoting movement about the protrusion 14, the contact lever 1 simultaneously comes into contact with the other protrusion 15 of the bent end 9 of the wall element 6 and now pivots about this protrusion 15, as its new point of rotation, until the bearing pin 12, moving along the path 16, has attained its terminal point 18 and the contact has been fully opened. This embodiment of the contact device in the "off" position is illustrated in FIG. 3.

In FIG. 2, the lever arms A and B are shown. They are located, respectively, between the contact 3, 4 and the protrusion 14 and between the protrusion 14 and the engagement point of the spring 13. These lever arms A and B represent a standard for the break-open, which is exerted on the contact 3, 4 and is generated by the spring force P. It can be seen from FIG. 2 that the break-open force is proportional to the torque exerted by the spring force P, this proportion being given by the ratio of B to A. In other words, in order to attain a great break-open force, the ratio of B to A should be as high as possible; that is, the protrusion 14 should be located as close as possible to the contact 3, 4.

However, this condition has the consequence that the contact opening, which is attained in the "off" position (that is, the distance of the contact point 3 of the contact lever 1 from the fixed contact element) becomes relatively small; for a specific, desired break-open force and the corresponding ratio of the distances A and B, it becomes so small that the existing conditions for minimum contact spacing cannot be met. Naturally, it would be possible, per se, to eliminate this deficiency by lengthening the total displacement path of the bearing pin 12 (marked by the letter W in FIG. 3) to an appropriate extent. However, it is desirable to make switches, and particularly circuit breakers, as compact as possible, and so lengthening this path in this manner and to the desired extent is either impossible or is associated with other severe structural handicaps.

In the contact device according to the invention, these deficiencies are eliminated, as may be seen from FIG. 3, in the manner which will now be described. The contact opening path K, which is attained in the "off" position, is determined according to the invention not by the lever arm ratio of B to A (FIG. 2) representing the standard for breaking apart the contact point 3 of the contact lever 1 from the fixed contact element 4, nor by the ratio of the lever arm A to the lever arm which is located between the protrusion 14 and the bearing pin 12 in FIG. 2, this latter ratio being relatively small. Instead, as shown in FIG. 3, the contact opening path K is proportional to the ratio of C to D; that is, it is proportional to the ratio of the lever arm located between the contact point 3 of the contact lever 1 and the protrusion 15 to the lever arm which is located between the protrusion 15 and the bearing pin 12. This latter ratio is substantially higher than the previously mentioned ratio.

The contact device, according to the invention, thus enables the attainment of a greater contact-breaking force upon the tripping of the switch, while still maintaining the contact spacing which is required in the "off" position. In addition, this advantageous result is attained without undergoing additional manufacturing expense, because the only alteration that needs to be made in conventional switches is that the stop for the contact lever 1, which is embodied in the illustrated example by the bent end 9 of the wall element 6, must be shaped differently, in accordance with the invention and as shown in FIGS. 1–3.

In the exemplary embodiment of FIGS. 1–3, the two protrusions 14 and 15, located spaced apart from one another along the contact lever 1, act as the stop for the contact lever 1. Instead of the two separate protrusions 14, 15, the bent end 9 of the wall element 6 may also be provided with a continuous contact surface 20 for the contact lever 1; this is shown in broken lines in FIGS. 1–3. During the transition of the contact lever 1 from the "on" position (FIG. 1) into the "off" position (FIG. 3), the contact lever 1 rolls off along the contact surface 20, while still maintaining the above-described lever arm ratios.

The present invention has been discussed in terms of its application to a known circuit breaker. However, the features of the invention are also applicable arbitrarily to any other switches, known to those ordinarily skilled in the art, having a spring-loaded contact lever, the bearing point of which executes a translatory movement when it is triggered, so as to attain a great contact-breaking force associated with a sufficiently long contact-opening path.

What is claimed is:

1. A contact device in a switch, in particular in a circuit breaker, having a movable contact lever under spring pressure, which on one end includes a contact point for an associated fixed contact element and on its other end is pivotally supported on pin means of a tripping system which when tripped displaces said pin means in a direction transverse to the longitudinal direction of said contact lever, a stop for the contact lever being disposed between the two ends in order to pivot the contact lever about the stop upon a displacement of said pin means and thereby to disengage its contact point from the fixed contact element, said stop having at least two contact locations for the contact lever, which locations are spaced apart from the contact lever and from its supported end by different amounts, in such manner that the contact lever, beginning at its position in which its contact point rests on the fixed contact element, upon displacement of its supported end first comes into contact with the contact location, which is the most remote from the supported end and then, before the termination of the displacement, comes into contact with the contact location of the stop, which is located closest to the supported end, and a compression spring supported on a housing element and acting upon the contact lever at a point located between the end of the contact lever supported on said pin means and the contact location of the stop located closest to said end.

2. A contact device as defined by claim 1, characterized in that the stop comprises two protrusions of a rib-like inner wall element of the switch, the protrusion which is more remote from the supported end of the contact lever being spaced apart by a lesser distance from the contact lever located in the closed position than is the protrusion located closer to the supported end of the contact lever.

3. A contact device as defined by claim 1, characterized in that the stop has a contact surface for the contact lever, which is at an at least approximately continuous distance apart from the contact lever, in the direction toward the supported end of the contact lever, when the contact lever is in its "on" position.

* * * * *